US008459151B2

(12) United States Patent
Wang et al.

(10) Patent No.: US 8,459,151 B2
(45) Date of Patent: Jun. 11, 2013

(54) RATCHETING SOCKET WRENCH AND SOCKETS

(75) Inventors: Qiang Wang, Shanghai (CN); Hua An Xu, Shanghai (CN)

(73) Assignee: Meridian International Co., Ltd. (CN)

( * ) Notice: Subject to any disclaimer, the term of this patent is extended or adjusted under 35 U.S.C. 154(b) by 218 days.

(21) Appl. No.: 12/962,020

(22) Filed: Dec. 7, 2010

(65) Prior Publication Data

US 2011/0290084 A1 Dec. 1, 2011

(30) Foreign Application Priority Data

May 28, 2010 (CN) ..... 2010 2 0208332 U
Sep. 14, 2010 (CN) ..... 2010 3 0516296

(51) Int. Cl.
*B25B 13/46* (2006.01)
*B25B 13/06* (2006.01)

(52) U.S. Cl.
USPC ..... 81/63.2; 81/124.3

(58) Field of Classification Search
USPC ..... 81/60–63.2, 121.1, 124.3, 124.7, 81/177.85
See application file for complete search history.

(56) References Cited

U.S. PATENT DOCUMENTS 841,686 A * 1/1907 Hatfield ..... 81/61
4,259,883 A 4/1981 Carlson
4,308,768 A * 1/1982 Wagner ..... 81/60
4,328,720 A 5/1982 Shiel
4,515,044 A * 5/1985 Harstad ..... 81/61
4,901,608 A 2/1990 Shieh
5,076,121 A 12/1991 Fosella
5,178,047 A 1/1993 Arnold et al.
5,199,330 A 4/1993 Arnold et al.
5,199,335 A 4/1993 Arnold et al.
5,295,422 A * 3/1994 Chow ..... 81/124.3
D353,756 S * 12/1994 Graves ..... D8/29
5,448,930 A * 9/1995 Miner et al. ..... 81/57.39
5,454,283 A 10/1995 Stefano
5,626,062 A * 5/1997 Colvin ..... 81/63.2
5,636,557 A 6/1997 Ma
5,647,252 A * 7/1997 Miner ..... 81/62
5,848,561 A 12/1998 Hsieh
5,857,390 A 1/1999 Whiteford
5,901,620 A 5/1999 Arnold
6,000,302 A 12/1999 Chiang (Continued)

OTHER PUBLICATIONS

Mar. 29, 2011 USPTO Office Action from related U.S. Appl. No. 29/379,971.

(Continued)

*Primary Examiner* — David B Thomas
(74) *Attorney, Agent, or Firm* — Jason R. Sytsma; Shuttleworth & Ingersoll, PLC

(57) ABSTRACT

A wrench for action on a work piece is provided. The wrench is a box end socket wrench. The socket wrench has an elongated handle with a box head. The box head has a top and a bottom surface and an inner wall defining an inner aperture. The inner wall is shaped to receive the work piece and has a receiving groove spaced apart from the top surface of the box head to receive a biased member. The biased member extends into the inner aperture of the box head to releasably secure the work piece. When the work piece is inserted in the inner aperture of the box head, the work piece sits flush with the corresponding top and bottom surface of the box head of the wrench.

24 Claims, 8 Drawing Sheets

U.S. PATENT DOCUMENTS

| | | | | |
|---|---|---|---|---|
| 6,006,631 | A * | 12/1999 | Miner et al. | 81/177.85 |
| 6,134,990 | A | 10/2000 | Ling et al. | |
| 6,148,695 | A | 11/2000 | Hu | |
| 6,216,567 | B1 | 4/2001 | Hu | |
| 6,263,767 | B1 | 7/2001 | Hu | |
| 6,282,991 | B1 | 9/2001 | Hu | |
| 6,286,396 | B1 | 9/2001 | Johnson | |
| 6,295,898 | B1 | 10/2001 | Hsieh | |
| 6,301,998 | B1 | 10/2001 | Hu | |
| 6,305,246 | B1 | 10/2001 | Horvath | |
| 6,405,621 | B1 | 6/2002 | Krivec et al. | |
| 6,450,068 | B1 | 9/2002 | Hu | |
| 6,453,779 | B2 | 9/2002 | Hu | |
| 6,457,387 | B1 | 10/2002 | Hu | |
| 6,481,315 | B1 | 11/2002 | Chang et al. | |
| 6,568,299 | B2 | 5/2003 | Hu | |
| 6,644,148 | B2 | 11/2003 | Hu | |
| 6,647,832 | B2 | 11/2003 | Hu | |
| 6,722,234 | B2 | 4/2004 | Hu | |
| 6,732,614 | B2 | 5/2004 | Hu | |
| 6,860,175 | B2 | 3/2005 | Hu | |
| 6,868,759 | B2 * | 3/2005 | Tuan-Mu | 81/63.2 |
| 6,877,404 | B2 | 4/2005 | Chen | |
| 6,918,323 | B2 | 7/2005 | Arnold et al. | |
| 6,971,286 | B2 | 12/2005 | Hu | |
| 7,032,478 | B2 * | 4/2006 | Hu | 81/63.2 |
| 7,051,623 | B2 | 5/2006 | Chaconas | |
| 7,055,409 | B2 * | 6/2006 | Hsien | 81/60 |
| 7,062,992 | B2 | 6/2006 | Spirer | |
| 7,066,059 | B1 | 6/2006 | Hsieh | |
| D525,495 | S | 7/2006 | Hsieh | |
| 7,073,412 | B1 | 7/2006 | Arnold | |
| 7,185,566 | B2 | 3/2007 | Arnold et al. | |
| 7,222,557 | B2 | 5/2007 | Li et al. | |
| 7,231,851 | B2 | 6/2007 | Tuan-Mu | |
| 7,311,019 | B2 | 12/2007 | Arnold et al. | |
| 7,318,366 | B2 | 1/2008 | Lee et al. | |
| 7,380,481 | B2 * | 6/2008 | Barnett et al. | 81/63 |
| D580,721 | S | 11/2008 | Chen | |
| 7,478,577 | B1 | 1/2009 | Wheeler | |
| 2003/0126957 | A1 * | 7/2003 | Huang | 81/60 |
| 2005/0178247 | A1 | 8/2005 | Arnold et al. | |
| 2005/0247167 | A1 | 11/2005 | Chaconas et al. | |
| 2007/0204727 | A1 | 9/2007 | Lee et al. | |
| 2008/0047402 | A1 | 2/2008 | Lin | |
| 2008/0092696 | A1 | 4/2008 | Arnold et al. | |
| 2009/0049957 | A1 | 2/2009 | Chang | |
| 2010/0050829 | A1 | 3/2010 | Chen | |

OTHER PUBLICATIONS

Gearwrench—Magnetic Oil Drain Plug Sockets—Screen print from webpage http://www.gearwrench.com/catalog/specialty_tools/magnetic_oil_drain_plug_sockets.

Facom 464.J1PB Socket Set—Promotional piece of literature dated Sep. 2009.

Smoos Tool Co., Ltd. Interchangeable Ratchet-Teeth Sockets—Promotional piece of literature.

* cited by examiner

RATCHETING SOCKET WRENCH AND SOCKETS

This application claims priority to Chinese Patent Application 201020208332.6 filed May 28, 2010 and Chinese Patent Application 201030516296.5 filed Sep. 14, 2010, the entirety of which is incorporated by reference herein.

BACKGROUND OF THE INVENTION

The present invention relates to wrenches, and more specifically, to a box end socket wrench.

The reversible ratchet wrench has been known for years and there are numerous tools that have been disclosed with varying handles, drive means, pawl, and means for reversing the operation of the wrench.

The disadvantage of most ratcheting socket wrenches, however, is their size. Many times the ratchet and socket mechanism simply will not fit into the work envelope. Another common problem is that many times the insertion or removal of a fastener may be initiated with a ratcheting socket wrench, yet an open-end or box wrench is often required to finish the process. Such a situation may occur when, for example, space limitations around a fastener increase as the fastener's head position changes during insertion or removal. In this situation, it is common to have and employ both a ratcheting socket wrench and an open-end or box wrench. This entails the purchase of a wrench and a socket for each fastener size. Storage space becomes an issue, and there is the added annoyance of assuring that both wrench types are accessible when needed.

SUMMARY OF THE INVENTION

A wrench adapted to receive a socket from a set of sockets is disclosed. The wrench is a ratcheting wrench with a box end attached to an elongated handle. The ratcheting mechanism includes an annular ratchet ring mounted within an aperture of the box head. The annular ratchet ring has a plurality of teeth around an outer wall and an inner wall shaped to receive a removable socket defining an inner aperture. Inside the annular ring is a groove positioned approximately half way from the top surface of the box head. An annular spring is positioned in the groove and extends into the inner aperture of the ratchet ring to releasably secure the socket. A biased pawl positioned in the box head engages the teeth of the annular ratchet ring to provide selective one-way rotation of the annular ratchet ring.

The removable sockets have a hexagonal outer shape and an engagement mechanism on their outer wall to receive the annular spring to releasably secure the socket to the wrench. When the sockets are inserted into the inner aperture of the ratcheting ring, a top and a bottom surface of the socket sits flush with the corresponding top and bottom surface of the box head of the wrench.

The engagement mechanism is a step or a notch formed on the outside of the socket. The engagement mechanism engages the annular spring to prevent the socket from passing through the inner aperture of the wrench.

In another embodiment, the box head is pivotally attached to the elongated handle for selectively positioning the box head in an angular position with respect to the handle. In yet another embodiment, the wrench is a box end socket wrench. The socket wrench has an elongated handle and a box head attached thereto. The box head has a top and a bottom surface and an inner wall defining an inner aperture. The inner wall is shaped to receive the work piece. The inner wall has a receiving groove spaced apart from the top surface of the box head to receive a biased member. The biased member extends into the inner aperture of the box head to releasably secure the work piece.

BRIEF DESCRIPTION OF THE DRAWINGS

For a more complete understanding of particular embodiments and their features and advantages, reference is now made to the following description, taken in conjunction with the accompanying drawings, in which.

DETAILED DESCRIPTION OF THE ILLUSTRATIVE EMBODIMENTS

Figure 1:
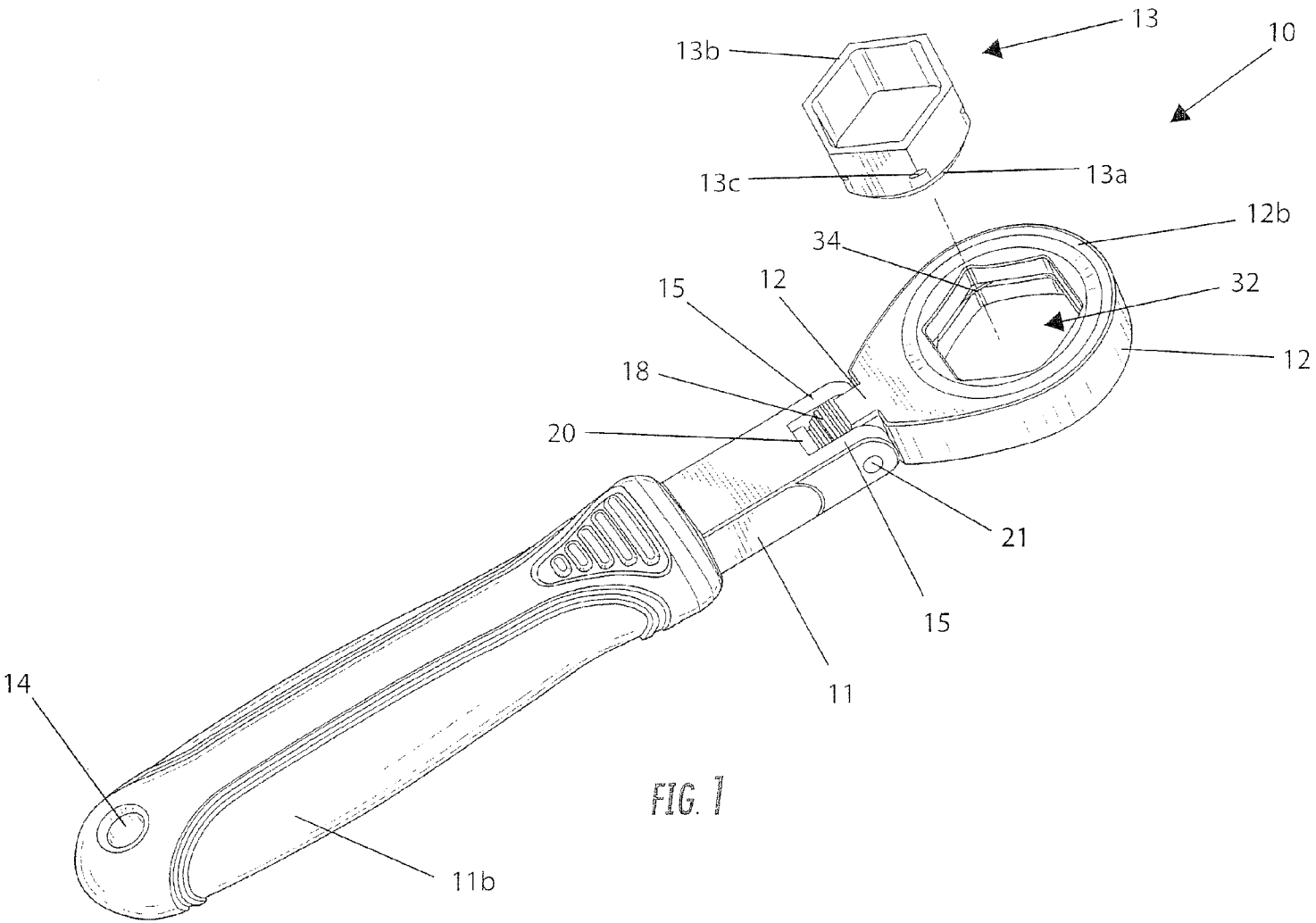
FIG. 1 is a perspective view of an illustrative embodiment of the ratcheting socket wrench and a socket.
Figure 2:
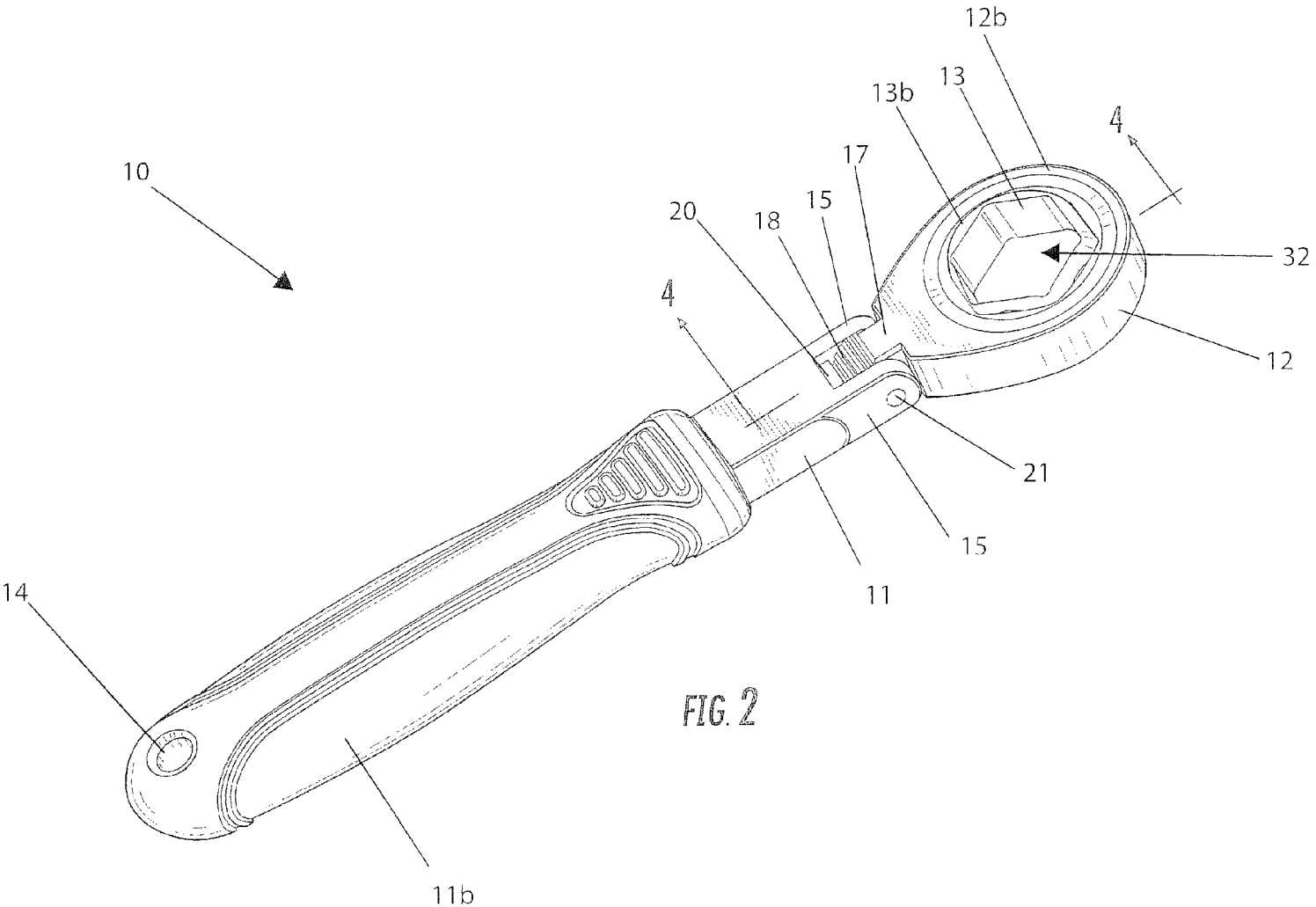
FIG. 2 is a perspective view of the illustrative embodiment of FIG. 1 with the socket inserted into the socket wrench.

FIGS. 1-6 illustrate an embodiment of the present invention of a ratcheting socket wrench 10. Wrench 10 is comprised of a handle 11 with a box head 12 adapted to receive a removable socket 13 that sits with its top and bottom faces 13*a* and 13*b* substantially flush with a top face 12*a* and a bottom face 12*b* of wrench 10. In this arrangement, wrench 10 and socket 13 combination is capable of insertion into hard to reach places where a typical socket wrench with a socket that extends above the face of the wrench is incapable of being used.

Handle 11 has a molded plastic or rubberized cover 11*b* that fits over handle 11 to provide an ergonomically comfortable gripping surface. At one end, handle 11 has a hole 14 for hanging the tool for storage. At an opposing end, handle 11 has two pivoting lugs 15 for receiving head 12.

Figure 4:
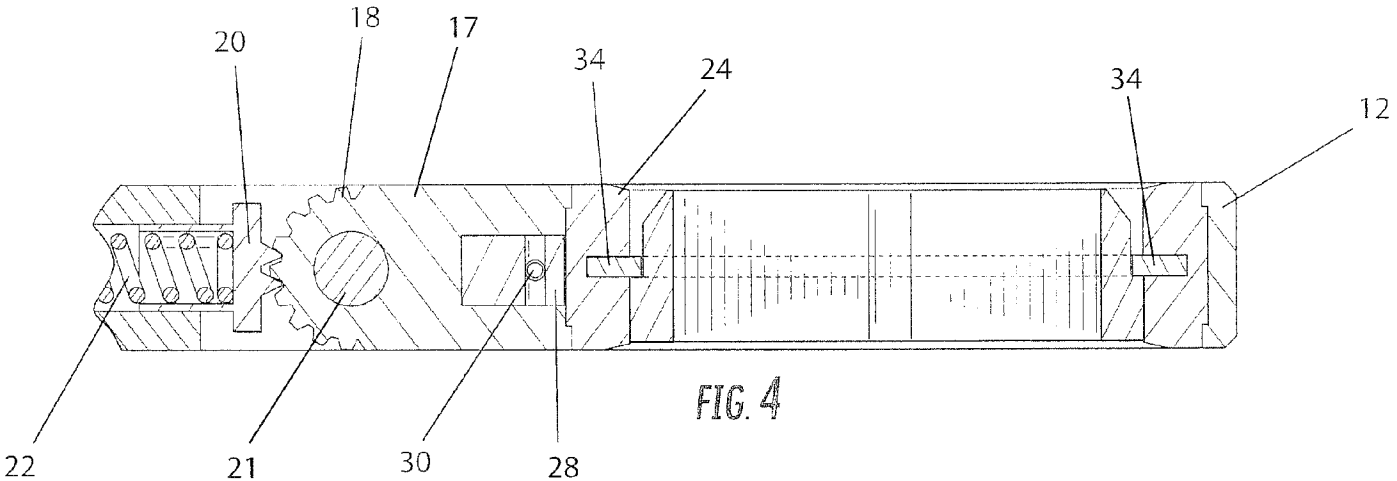
FIG. 4 is a cut-away view of the illustrative embodiment of FIG. 2 taken along the line 4-4.
Figure 5:
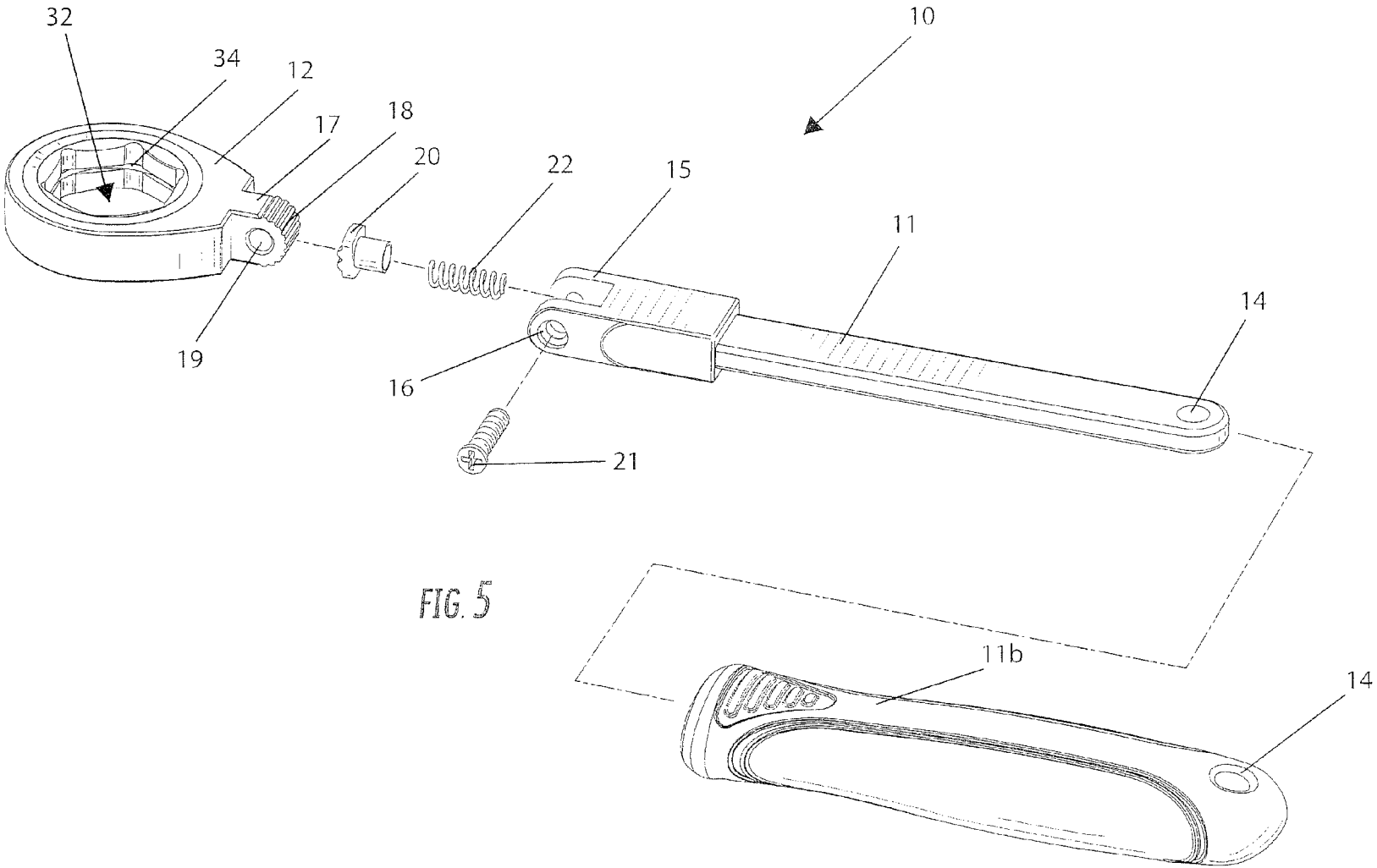
FIG. 5 is an exploded view of the illustrative embodiment of FIG. 1.

Pivoting head 12 pivots in a semi-circular arc with respect to the length of handle 11. Two aligned holes 16 are located in lugs 15. Aligned holes 16 correspond to a through hole 19 on a protrusion 17 extending from head 12. A pin 18 through aligned holes 16 and through hole 19 joins handle 11 with head 12 and provides an axis of rotation for head 12 to pivot with respect to handle 11. Referring to FIGS. 4 and 5, protrusion 17 has a plurality of teeth 18 arranged in a semicircular pattern. A pawl 20 is outwardly biased by a spring 22 from handle 11 to engage teeth 18 and secure head 12 in position. Head 12 is repositionable by the user, however, with the application of sufficient external force to overcome the biasing force of spring 22. In which instance, the user can reposition pivoting head 12 to any position within a semicircular arc with respect to handle 11. Although ratcheting socket wrench 10 is provided with a pivoting head 12, alternate embodiments with a fixed head 12 formed to handle 11 is contemplated by this disclosure.

Figure 6:
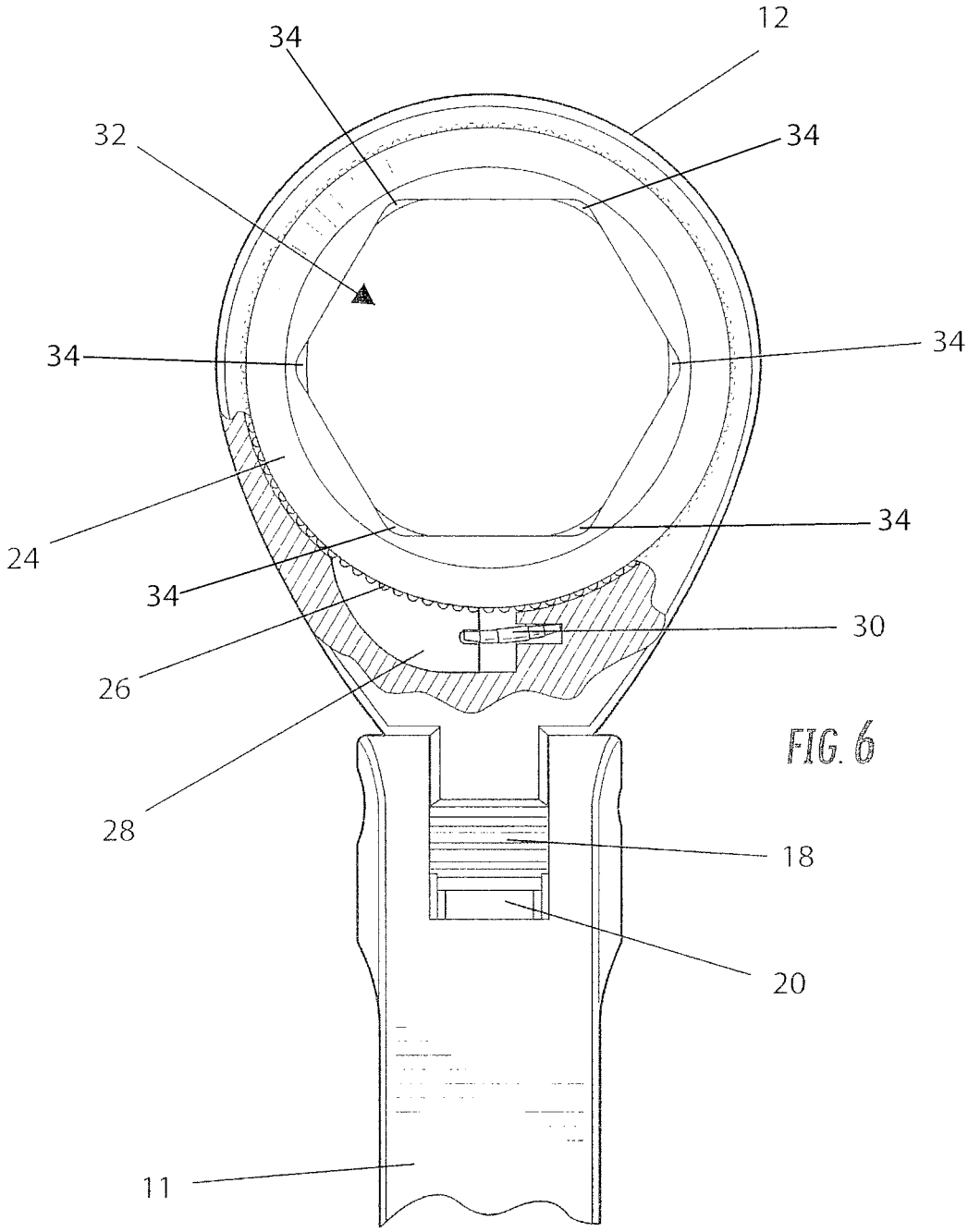
FIG. 6 is a top cut-away view of the illustrative embodiment of FIG. 1.

Referring to FIG. 6, head 12 is a ratcheting head that comprises an internal annular ring 24 having an outer wall and inner wall, the outer wall being circumscribed by a plurality of teeth 26. A second pawl 28 biased by a second spring 30 engages teeth 26 to allow one-way rotation of annular ring 24. The inner wall of annular ring 24 is hexagonal shaped with an aperture 32 formed in the center of head 12. The shape of aperture 32 corresponds to the outer shape of sockets 13. The internal shape of sockets 13 takes the form of typical fasteners, such as square, 12 point, hex, rounded hex, Torx, and spline.

Annular ring 24 rotates in a single direction. When wrench 10 is viewed as shown in FIG. 6, annular ring 24 rotates in a clockwise direction. Viewed from the opposite side, however, annular ring 24 rotates in a counter-clockwise direction. Wrench 10 has its ratcheting mechanism disposed around the periphery of head 12 and its center is open, which simplifies the manufacture of wrench 10 by removing the requirement of mechanical mechanism to control direction. To switch rotational direction of wrench 10, a user merely has to flip wrench 10 over to its other side.

Figure 10:
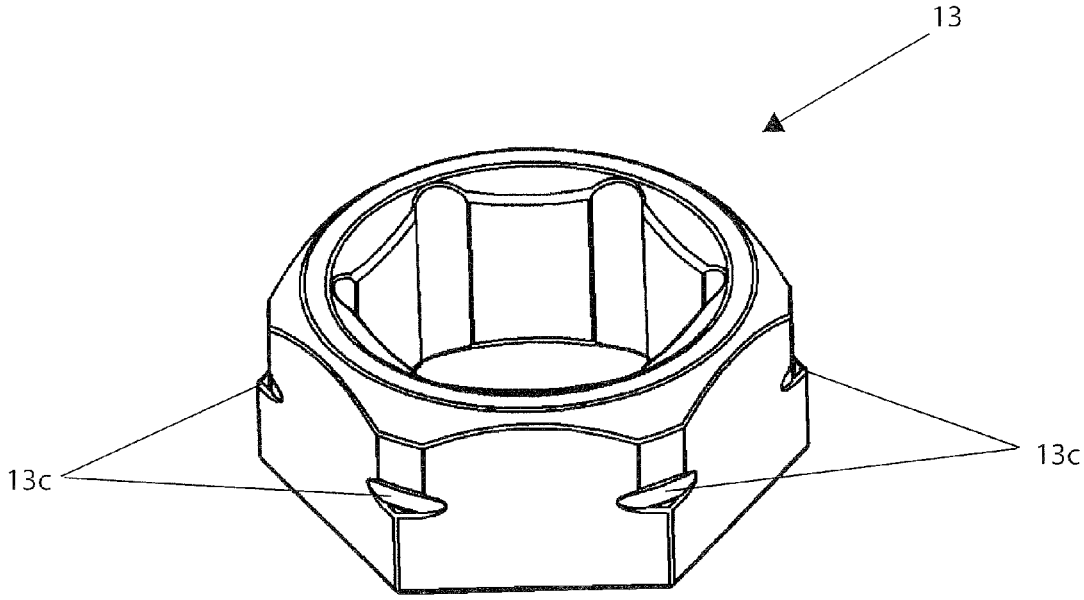
FIG. 10 is a perspective view of the socket of FIG. 1.

Referring to FIG. 10, socket 13 has an engagement mechanism 13*c*, which can take the form of a step or a groove around the outer periphery of sockets 13. Engagement mechanism 13*c* is illustrated as a step and is formed by the external corners on the hexagonal periphery of sockets 13 cut halfway down forming a flat surface perpendicular to the step. Alternatively, however, engagement mechanism 13*c* is a notch or groove formed approximately half-way down on the edge of each hexagonal corner. One skilled in the art will recognize that aperture 32 in head 12 can be any shape to mate with a corresponding outer shape of socket 13 and the illustrated hexagonal shape is but one possible embodiment.

Figure 9:
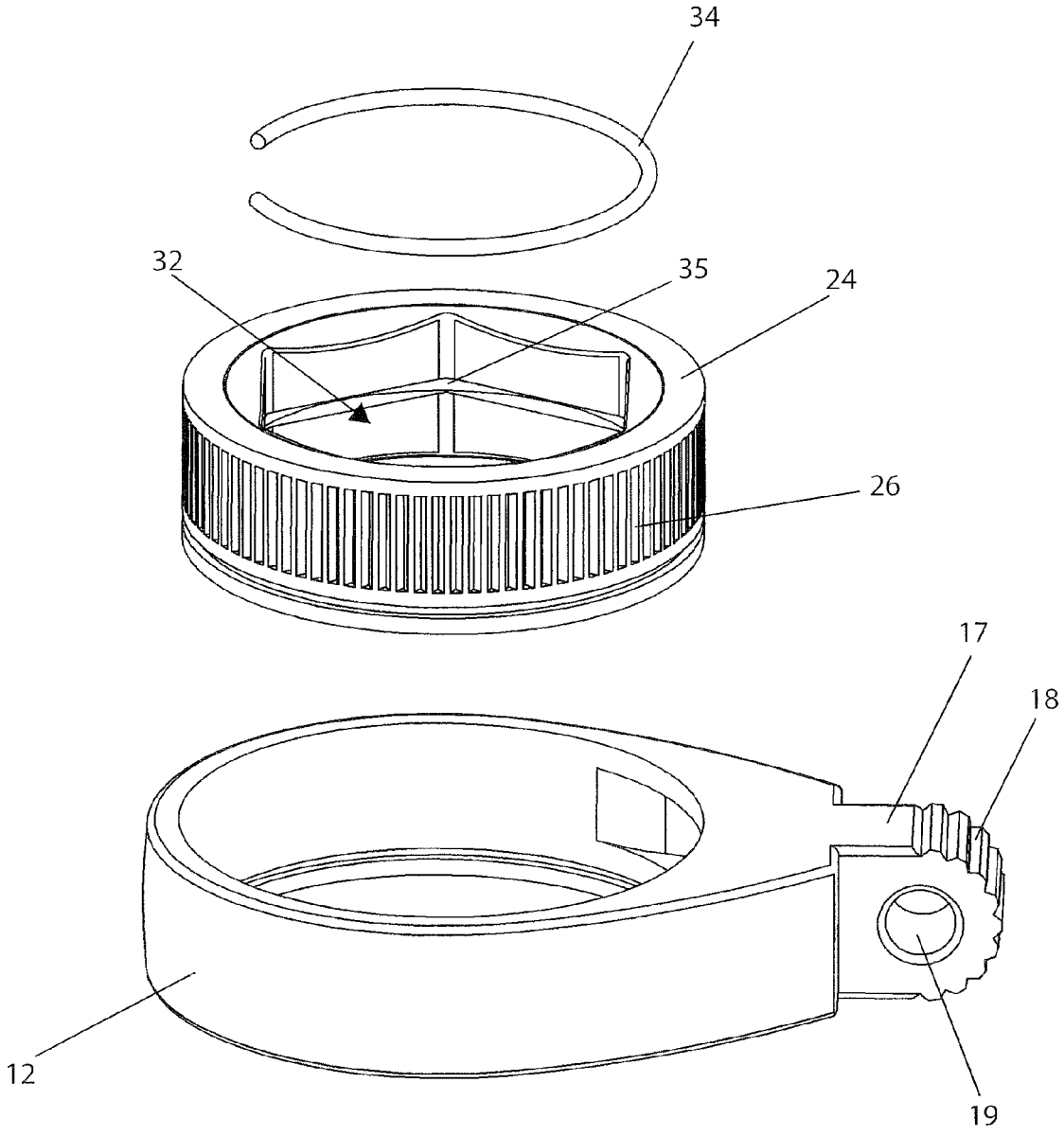
FIG. 9 is an exploded view of the box end of the ratcheting socket wrench of FIG. 1.

Referring to FIG. 9, aperture 32 has a locking spring 34 disposed in a groove 35 that circumscribes its periphery. The position of locking spring 34 corresponds with the position of engagement mechanism 13*c* on socket 13. In the illustrated embodiment, locking spring 34 is disposed around the center of aperture 32. Locking spring 34 has a diameter slightly smaller than the diameter of groove 35. When a socket 13 is inserted in aperture 32, locking spring 34 can expand into groove 35 and contracts when it is aligned with engagement mechanism 13*c* of socket 13 to secure socket 13 in position.

Figure 3:
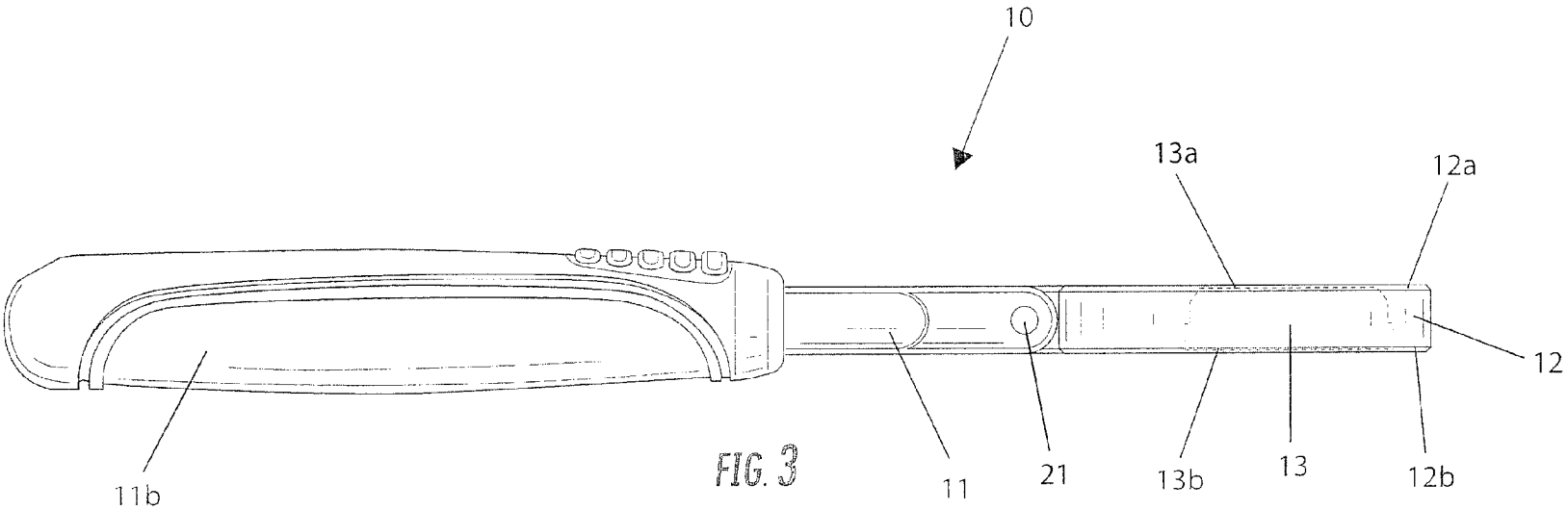
FIG. 3 is a side view of the illustrative embodiment of FIG. 2.

The mechanics for holding sockets 13 secure with wrench 10 is disposed inside head 12 to allow sockets 13 to fit flush with top face 12*a* and bottom face 12*b*. As shown in FIG. 3, socket 13 is disposed in wrench 10 with top face 13*a* of socket 13 flush with top face 12*a* of head 12 and bottom face 13*b* of socket 13 flush with bottom face 12*b* of head 12. This arrangement provides a compact box end wrench and provides for quickly adding or removing sockets 13. Furthermore, sockets 13 take up no additional vertical space. This means wrench 10 is useable in places that are otherwise inaccessible to typical socket wrenches.

Figure 7:
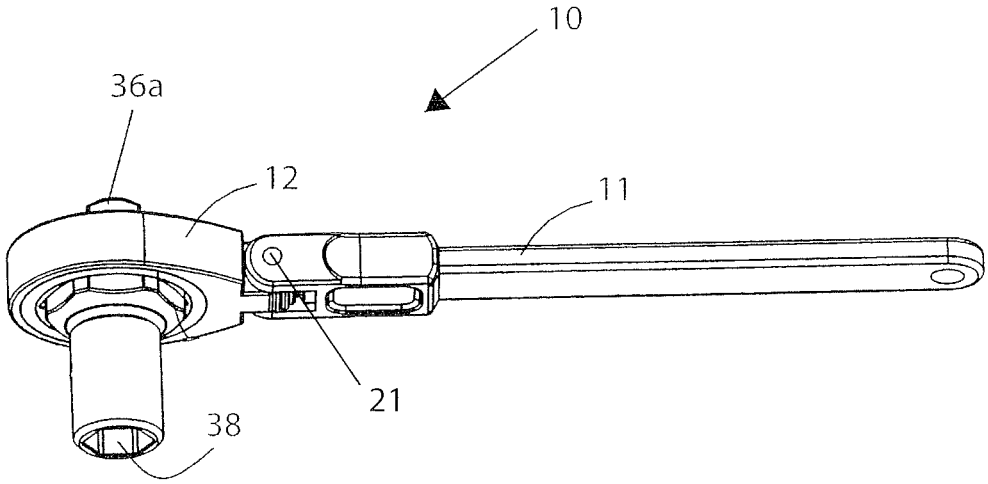
FIG. 7 is a perspective view of the illustrative embodiment of the ratcheting socket wrench and with socket adapter for mating with standard sockets.
Figure 8:
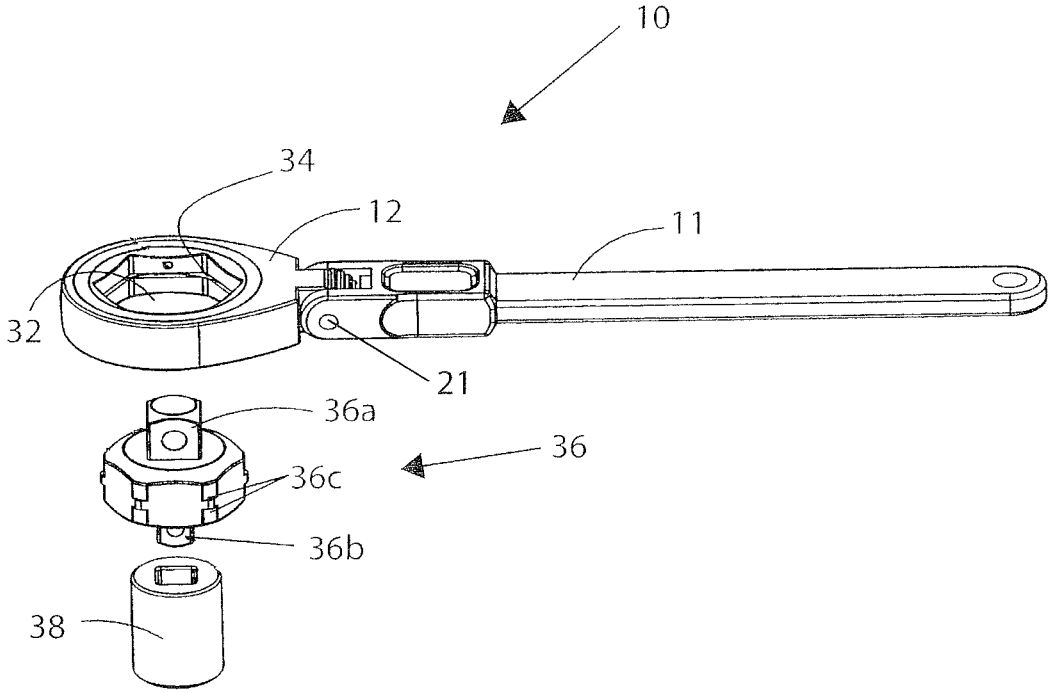
FIG. 8 is a perspective view of the wrench and socket adapter of FIG. 7 with the adapter outside the wrench.

Ratcheting socket wrench 10 is also adaptable for use with all standard sockets. Referring to FIGS. 7 and 8, an adapter 36 is provided that mates with corresponding standard socket 38. Adapter 36 has a pair of square fittings 36*a* and 36*b* to correspond with two drive sizes for socket. For example 36*a* maybe a ¼ inch drive and 36*b* maybe a ⅜ inch drive. An engagement mechanism 36*c* is around the periphery of adapter 36 for it to fit into aperture 32 of wrench 10 in a similar manner as previously discussed.

While the present invention has been particularly shown and described with reference to exemplary embodiments thereof, it should be understood by those of ordinary skill in the art that various changes, substitutions and alterations could be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A wrench for action on a work piece, the wrench comprising:

a wrench body having an elongated handle and a box head attached thereto, the box head having a top and a bottom surface and an aperture therethrough;

an annular ratchet ring mounted within the aperture of the box head, the annular ratchet ring having a top and a bottom surface substantially flush with a corresponding top and bottom surface of the box head and having a plurality of teeth around an outer wall and having its periphery and an inner wall defining an inner aperture, the inner wall being shaped to receive the work piece, the inner wall further having a receiving groove spaced apart from a top surface of the ratcheting ring;

a biased pawl positioned within the box head and engaging the teeth of the annular ratchet ring to provide selective one-way rotation of the annular ratchet ring; and a biased member positioned in the receiving groove and extending into the inner aperture of the ratchet ring to releasably secure the work piece;

the work piece having an engagement mechanism on its outer wall, the engagement mechanism being adapted to receive the the biased member to releasably secure the work piece to the wrench, and a top and a bottom surface that, when inserted in the inner aperture of the ratcheting ring, sits flush with the corresponding top and bottom surface of the box head of the wrench, wherein the engagement mechanism of the work piece is a step defined by a flat surface perpendicular to the outer wall of the work piece, wherein the step engages the biased member to prevent the socket from passing through the inner aperture of the ratchet ring.

2. The wrench of claim 1, wherein the receiving groove extends around the circumference of the inner wall.

3. The wrench of claim 1, wherein the biased member is an annular spring.

4. The wrench of claim 3, wherein the receiving groove is positioned substantially half-way between the top and the bottom surface of the annular ratchet ring and extends around the periphery of the inner wall.

5. The wrench of claim 4, and further comprising the work piece, wherein the work piece is a socket having an engagement mechanism on its outer wall, the engagement mechanism being adapted to receive the annular spring to releasably secure the socket to the wrench, and a top and a bottom surface that, when inserted in the inner aperture of the ratcheting ring, sits flush with the corresponding top and bottom surface of the box head of the wrench.

6. The wrench of claim 3, and further comprising the work piece, wherein the work piece is a socket having an engagement mechanism on its outer wall, the engagement mechanism being adapted to receive the annular spring to releasably secure the socket to the wrench, and a top and a bottom surface that, when inserted in the inner aperture of the ratcheting ring, sits flush with the corresponding top and bottom surface of the box head of the wrench.

7. The wrench of claim 1 wherein the engagement mechanism of the work piece is a notch formed in the outer wall of the work piece, wherein the notch receives the annular spring to prevent the work piece from passing through the inner aperture of the ratchet ring.

8. The wrench of claim 1, wherein the work piece has a hexagonal shaped outer wall and the engagement mechanism is a notch formed in each edge of the hexagon, wherein the notch engages the biased member to prevent the work piece from passing through the inner aperture of the ratchet ring.

9. A wrench for action on a work piece, the wrench comprising:

a wrench body having an elongated handle and a box head attached thereto, the box head having a top and a bottom surface and an aperture therethrough;

an annular ratchet ring mounted within the aperture of the box head, the annular ratchet ring having a top and a bottom surface substantially flush with a corresponding top and bottom surface of the box head and having a plurality of teeth around an outer wall and having its periphery and an inner wall defining an inner aperture, the inner wall being shaped to receive the work piece, the inner wall further having a receiving groove spaced apart from a top surface of the ratcheting ring;

a biased pawl positioned within the box head and engaging the teeth of the annular ratchet ring to provide selective one-way rotation of the annular ratchet ring; and a biased member positioned in the receiving groove and extending into the inner aperture of the ratchet ring to releasably secure the work piece;

the work piece having an engagement mechanism on its outer wall, the engagement mechanism being adapted to receive the the biased member to releasably secure the work piece to the wrench, and a top and a bottom surface that, when inserted in the inner aperture of the ratcheting ring, sits flush with the corresponding top and bottom surface of the box head of the wrench, wherein the work piece has a hexagonal shaped outer wall and the engagement mechanism is a step defined by a flat surface perpendicular to the outer wall on each edge of the hexagon, wherein the step engages the biased member to prevent the work piece from passing through the inner aperture of the ratchet ring.

10. A wrench for action on a socket, the wrench comprising:

a wrench body having an elongated handle and a box head attached thereto, the box head having a top and a bottom surface and an aperture therethrough;

an annular ratchet ring mounted within the aperture of the box head, the annular ratchet ring having a top and a bottom surface substantially flush with the corresponding top and bottom surface of the box head and having a plurality of teeth around an outer wall and having its periphery and an inner wall defining an inner aperture, the inner wall being shaped to receive the socket, the inner wall further having a receiving groove positioned substantially half-way between the top and the bottom surface of the ratchet ring and circumscribing the inner aperture;

a biased pawl positioned within the box head and engaging the teeth of the annular ratchet ring to provide selective one-way rotation of the annular ratchet ring;

an annular spring positioned in the receiving groove and extending into the inner aperture of the ratchet ring to releasably secure the socket; and the socket having an engagement mechanism on its outer wall, the engagement mechanism being adapted to receive the annular spring to releasably secure the socket to the wrench, and a top and a bottom surface that, when inserted in the inner aperture of the ratchet ring, sits flush with the corresponding top and bottom surface of the box head, wherein the engagement mechanism of the socket is a step defined by a flat surface perpendicular to the outer wall of the socket, wherein the step engages the annular spring to prevent the socket from passing through the inner aperture of the ratchet ring.

11. The wrench of claim 10, wherein the receiving groove is positioned substantially half-way between the top and the bottom surface of the ratchet ring.

12. The wrench of claim 11, and further comprising a socket having an engagement mechanism on its outer wall, the engagement mechanism being adapted to receive the annular spring to releasably secure the socket to the wrench, and a top and a bottom surface that, when inserted in the inner aperture of the ratchet ring, sits flush with the corresponding top and bottom surface of the box head.

13. The wrench of claim 10, wherein the engagement mechanism of the socket is a notch formed in the outer wall of the socket, wherein the notch receives the annular spring to prevent the socket from passing through the inner aperture of the ratchet ring.

14. The wrench of claim 10, wherein the socket has a hexagonal shaped outer wall and the engagement mechanism is a notch formed in each edge of the hexagon, wherein the notch engages the annular spring to prevent the socket from passing through the inner aperture of the ratchet ring.

15. The wrench of claim 10, and further comprising a pivot joint between the box head and the handle for selectively positioning the box head in an angular position with respect to the handle.

16. A wrench for action on a work piece, the wrench comprising:

a wrench body having an elongated handle and a box head attached thereto, the box head having a top and a bottom surface and an aperture therethrough;

an annular ratchet ring mounted within the aperture of the box head, the annular ratchet ring having a top and a bottom surface substantially flush with the corresponding top and bottom surface of the box head and having a plurality of teeth around an outer wall and having its periphery and an inner wall defining an inner aperture, the inner wall being shaped to receive the work piece, the inner wall further having a receiving groove spaced apart from the top surface of the ratcheting ring and circumscribing the inner aperture;

a biased pawl positioned within the box head and engaging the teeth of the annular ratchet ring to provide selective one-way rotation of the annular ratchet ring;

an annular spring positioned in the receiving groove and extending into the inner aperture of the ratchet ring to releasably secure the work piece, wherein the work piece has a hexagonal shaped outer wall and has an engagement mechanism that is a step defined by a flat surface on each edge of the hexagon and perpendicular to the outer wall, wherein the step engages the annular spring to prevent the work piece from passing through the inner aperture of the ratchet ring.

17. A wrench for action on a work piece, the wrench comprising:

a wrench body having an elongated handle and a box head attached thereto, the box head having a top and a bottom surface and an inner wall defining an inner aperture, the inner wall being shaped to receive the work piece, the inner wall further having a receiving groove spaced apart from the top surface of the box head; and a biased member positioned in the receiving groove and extending into the inner aperture of the box head to releasably secure the work piece, the work piece having: a step defined by a fiat surface perpendicular to the outer wall of the work piece, the step being adapted to receive the biased member to releasably secure the work piece to the wrench to prevent the work piece from passing through the inner aperture of the box head; and a top surface and a bottom surface that, when inserted in the inner aperture of the box head, sits flush with the corresponding top and bottom surface of the box head of the wrench.

18. The wrench of claim 17, wherein the receiving groove extends around a circumference of the inner wall.

19. The wrench of claim 17, wherein the biased member is an annular spring.

20. The wrench of claim 19, wherein the receiving groove is positioned substantially half-way between the top and the bottom surface of the box head and extends around the periphery of the inner wall.

21. The wrench of claim 19, wherein the work piece is a socket having an engagement mechanism on its outer wall, the engagement mechanism being adapted to receive the annular spring to releasably secure the socket to the wrench, and a top and a bottom surface that, when inserted in the inner aperture of the box head, sits flush with the corresponding top and bottom surface of the box head of the wrench.

22. The wrench of claim 20, wherein the work piece is a socket having an engagement mechanism on its outer wall, the engagement mechanism being adapted to receive the annular spring to releasably secure the socket to the wrench, and a top and a bottom surface that, when inserted in the inner aperture of the box head, sits flush with the corresponding top and bottom surface of the box head of the wrench.

23. The wrench of claim 17 wherein the engagement mechanism of the work piece is a notch formed in the outer wall of the socket, wherein the notch receives the annular spring to prevent the work piece from passing through the inner aperture of the box head.

24. The wrench of claim 17, wherein the work piece has a hexagonal shaped outer wall.

* * * * *